US009709945B2

(12) United States Patent
Iwasaki

(10) Patent No.: US 9,709,945 B2
(45) Date of Patent: Jul. 18, 2017

(54) IMAGE FORMING APPARATUS AND IMAGE FORMING SYSTEM

(71) Applicant: Konica Minolta, Inc., Tokyo (JP)

(72) Inventor: Takahiro Iwasaki, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/141,295

(22) Filed: Apr. 28, 2016

(65) Prior Publication Data

US 2016/0334749 A1 Nov. 17, 2016

(30) Foreign Application Priority Data

May 13, 2015 (JP) ..... 2015-098000

(51) Int. Cl.
*G03G 15/20* (2006.01)
*G03G 15/00* (2006.01)

(52) U.S. Cl.
CPC ..... *G03G 15/6573* (2013.01); *G03G 2215/00654* (2013.01)

(58) Field of Classification Search
None
See application file for complete search history.

(56) References Cited

U.S. PATENT DOCUMENTS

2005/0196204 A1* 9/2005 Funato ..... G03G 15/2014 399/341
2008/0124153 A1* 5/2008 Kakishima ..... G03G 15/2028 399/341
2011/0020745 A1* 1/2011 Yu ..... G03G 9/0806 430/108.21
2012/0114358 A1* 5/2012 Sugiyama ..... G03G 15/2039 399/69
2014/0169850 A1* 6/2014 Matsuo ..... G03G 15/2021 399/341

FOREIGN PATENT DOCUMENTS

JP 2003195663 A * 7/2003
JP 2012-140223 A 7/2012

OTHER PUBLICATIONS

Machine translations of Saito (2003) and Ito (2012).*

* cited by examiner

*Primary Examiner* — Sevan A Aydin
(74) *Attorney, Agent, or Firm* — Osha Liang LLP

(57) ABSTRACT

An image forming apparatus includes: an image forming unit that forms an image by transferring toner onto a paper sheet; a fixing unit that fixes the image onto the paper sheet having the image formed thereon by the image forming unit; a charging unit that electrically charges the paper sheet having the image fixed thereonto by the fixing unit; and an adhesion preventing unit that prevents adhesion of wax to the charging unit, the wax being contained in the toner transferred onto the paper sheet, the adhesion preventing unit being located on an upstream side of the charging unit in a direction of conveyance of the paper sheet.

10 Claims, 8 Drawing Sheets

IMAGE FORMING APPARATUS AND IMAGE FORMING SYSTEM

The entire disclosure of Japanese Patent Application No. 2015-098000 filed on May 13, 2015 including description, claims, drawings, and abstract are incorporated herein by reference in its entirety.

BACKGROUND OF THE INVENTION

Field of the Invention

The present invention relates to an image forming apparatus that forms an image by transferring and fixing a toner image onto a paper sheet, and an image forming system that includes an image forming apparatus.

Description of the Related Art

There have been electrophotographic image forming apparatuses such as printers and copying machines. In such an image forming apparatus, a paper sheet might be electrostatically charged during image formation or paper conveyance. When such electrostatically charged paper sheets are discharged from the apparatus and are stacked, the repulsive force or adsorptive force generated between the paper sheets might cause a problem with the stacking.

To counter such a problem, a technology involving a charging unit that electrically charges paper sheets prior to stacking has been suggested (see JP 2012-140223 A, for example).

In an image forming apparatus, a latent image formed on a photosensitive drum is visualized through development with toner, the visualized toner image is transferred from the photosensitive drum onto a transfer belt by a primary transfer process, the toner image transferred onto the transfer belt is further transferred onto a paper sheet by a secondary transfer process, and the toner image transferred onto the paper sheet is fixed onto the paper sheet. In this manner, an image is formed on the paper sheet.

The toner to be used in the image forming apparatus has wax added thereto to enhance the separability between the fixing roller and a paper sheet in the fixing unit. In the image forming apparatus, the fixing unit heats and presses the paper sheet, to fix the toner onto the paper sheet.

If the temperature of the toner on the paper sheet that has passed through the fixing unit and is being conveyed into the charging unit is higher than the crystallization temperature of the wax, the wax is melted. If the paper sheet with the melted wax is conveyed into the charging unit, the wax adheres to the charging roller electrically charged by the charging unit. Since the wax is an insulator, the wax adhering to the charging roller degrades charging performance.

SUMMARY

In one or more embodiments of the present invention, an image forming apparatus and an image forming system prevent adhesion of the wax contained in toner at the charging unit.

An image forming apparatus reflecting one aspect of the present invention comprises: an image forming unit configured to form an image by transferring toner onto a paper sheet; a fixing unit configured to fix the image onto the paper sheet having the image formed thereon by the image forming unit; a charging unit configured to electrically charge the paper sheet having the image fixed thereonto by the fixing unit; and an adhesion preventing unit configured to prevent adhesion of wax to the charging unit, the wax being contained in the toner transferred onto the paper sheet, the adhesion preventing unit being located on an upstream side of the charging unit in a direction of conveyance of the paper sheet.

According to one or more embodiments, the adhesion preventing unit is a cooling unit configured to blow air onto the paper sheet, and the image forming apparatus further comprises a control unit configured to control the cooling unit in accordance with a toner temperature sensed by a temperature sensing unit configured to sense a temperature of the toner on the paper sheet having the toner fixed thereonto by the fixing unit, the control unit lowering the toner temperature to a temperature equal to or lower than a crystallization temperature of the wax.

According to one or more embodiments, a temperature of heat to be applied to the paper sheet by the fixing unit is controlled in accordance with a toner temperature sensed by a temperature sensing unit configured to sense a temperature of the toner on the paper sheet having the toner fixed thereonto by the fixing unit, and the toner temperature is lowered to a temperature equal to or lower than a crystallization temperature of the wax.

According to one or more embodiments, charge control to be performed on the charging unit is constant current control, and a potential of the paper sheet is controlled while a voltage value is varied.

According to one or more embodiments, charge control to be performed on the charging unit is constant voltage control, an amount of adhering toner is calculated from a cumulative print area on the paper sheet, and a value of voltage to be applied to the charging unit is corrected in accordance with an amount of adhering toner.

According to one or more embodiments, an amount of adhering toner is calculated from a print coverage rate on the paper sheet, and the cooling unit is controlled in accordance with an amount of adhering toner.

According to one or more embodiments, an amount of adhering toner is calculated from a print coverage rate on the paper sheet, and a temperature of heat to be applied to the paper sheet by the fixing unit is controlled in accordance with an amount of adhering toner.

According to one or more embodiments, the adhesion preventing unit includes a wax removing unit configured to remove the wax from the paper sheet.

According to one or more embodiments, charge control to be performed on the charging unit is constant current control, and a notification of a time to replace the charging unit is issued before a value of voltage to be applied to the charging unit exceeds a value of rated voltage.

According to one or more embodiments, charge control to be performed on the charging unit is constant voltage control, and a notification of a time to replace the charging unit is issued before a correction value for a value of voltage to be applied to the charging unit exceeds a value of rated voltage, the correction value being based on an amount of adhering toner calculated from a cumulative print area on the paper sheet.

An image forming system reflecting one aspect of the present invention comprises: an image forming apparatus including: an image forming unit configured to form an image by transferring toner onto a paper sheet; and a fixing unit configured to fix the image onto the paper sheet having the image formed thereon by the image forming unit; a charging device configured to electrically charge the paper sheet having the image fixed thereonto by the fixing unit; and an adhesion preventing device configured to prevent adhesion of wax to the charging device, the wax being contained in the toner transferred onto the paper sheet, the adhesion preventing device being located on an upstream side of the charging device in a direction of conveyance of the paper sheet.

BRIEF DESCRIPTION OF THE DRAWINGS

The above and other effects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION

Hereinafter, an image forming apparatus and an image forming system according to one or more embodiments of the present invention will be described with reference to the drawings. However, the scope of the invention is not limited to the illustrated examples.

<Example Structure of an Image Forming Apparatus>

Figure 1:
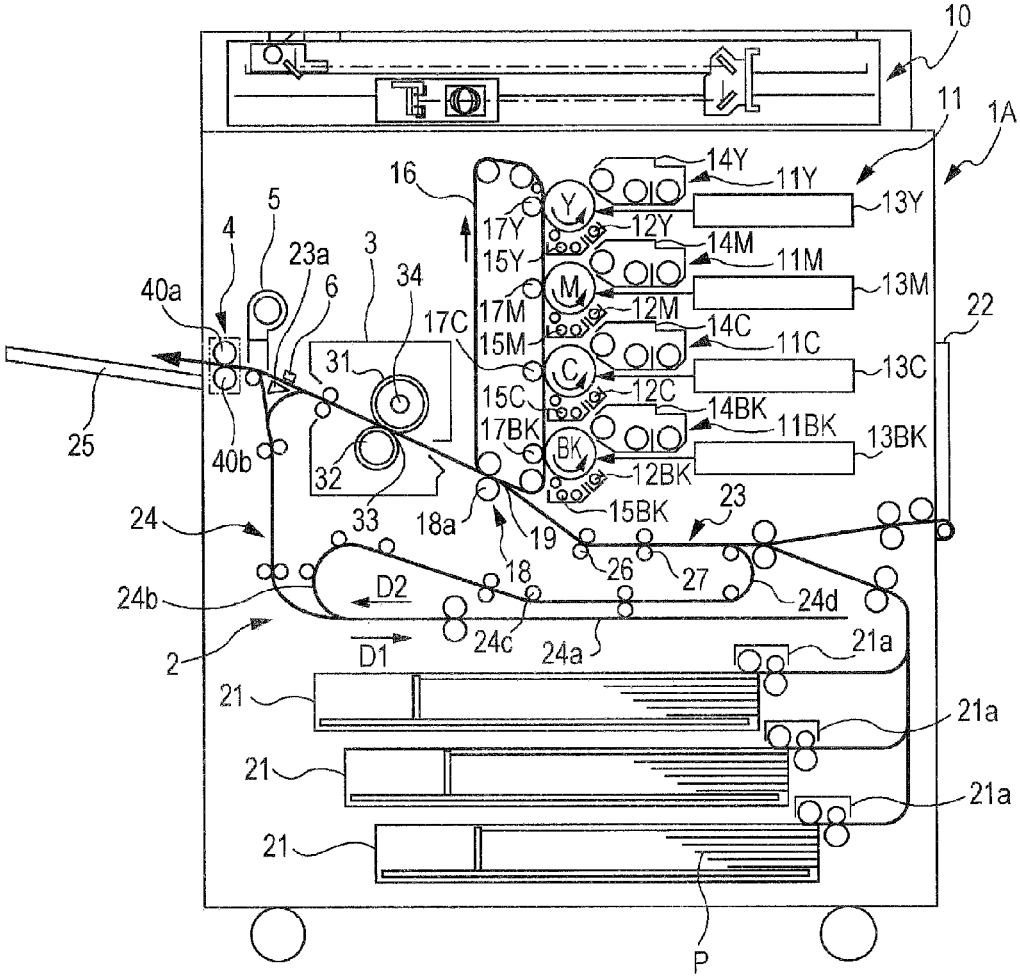
FIG. 1 is a diagram showing an example structure of an image forming apparatus according to one or more embodiments.

FIG. 1 is a diagram showing an example structure of an image forming apparatus according to an embodiment. An image forming apparatus 1A is an electrophotographic image forming apparatus, such as a copying machine. In this example, the image forming apparatus 1A is a tandem color image forming apparatus that has photosensitive members vertically arranged to face a single intermediate transfer belt, and forms full-color images.

The image forming apparatus 1A includes a document reading unit 10, an image forming unit 11, a paper conveying unit 2, a fixing unit 3, a charging unit 4, a cooling unit 5, and a temperature sensing unit 6.

The document reading unit 10 scans and exposes an image of a document with an optical system of a scanning exposure device, reads the reflected light with a line image sensor, and thus obtains an image signal. An automatic document conveyance device (not shown) that supplies documents to the image forming apparatus 1A may also be provided at an upper portion of the image forming apparatus 1A.

The image forming unit 11 is an example of the image forming unit, and includes an image forming unit 11Y that forms a yellow (Y) image, an image forming unit 11M that forms a magenta (M) image, an image forming unit 11C that forms a cyan (C) image, and an image forming unit 11BK that forms a black (BK) image.

The image forming unit 11Y includes a photosensitive drum Y, and a charging unit 12Y, an optical writing unit 13Y, a development device 14Y, and a drum cleaner 15Y, which are placed around the photosensitive drum Y. Likewise, the image forming units 11M, 11C, and 11BK include photosensitive drums M, C, and BK, and charging units 12M, 12C, and 12BK, optical writing units 13M, 13C, and 13BK, development devices 14M, 14C, and 14BK, and drum cleaners 15M, 15C, and 15BK, which are placed around the photosensitive drums M, C, and BK, respectively.

The surface of the photosensitive drum Y is uniformly charged by the charging unit 12Y, and a latent image is formed on the photosensitive drum Y by the optical writing unit 13Y performing scanning exposure. The development device 14Y further performs development with toner, to visualize the latent image on the photosensitive drum Y. As a result, an image (a toner image) in the predetermined color corresponding to yellow is formed on the photosensitive drum Y.

Likewise, the surface of the photosensitive drum M is uniformly charged by the charging unit 12M, and a latent image is formed on the photosensitive drum M by the optical writing unit 13M performing scanning exposure. The development device 14M further performs development with toner, to visualize the latent image on the photosensitive drum M. As a result, a toner image in the predetermined color corresponding to magenta is formed on the photosensitive drum M.

The surface of the photosensitive drum C is uniformly charged by the charging unit 12C, and a latent image is formed on the photosensitive drum C by the optical writing unit 13C performing scanning exposure. The development device 14C further performs development with toner, to visualize the latent image on the photosensitive drum C. As a result, a toner image in the predetermined color corresponding to cyan is formed on the photosensitive drum C.

The surface of the photosensitive drum BK is uniformly charged by the charging unit 12BK, and a latent image is formed on the photosensitive drum BK by the optical writing unit 13BK performing scanning exposure. The development device 14BK further performs development with toner, to visualize the latent image on the photosensitive drum BK. As a result, a toner image in the predetermined color corresponding to black is formed on the photosensitive drum BK.

The images formed on the photosensitive drums Y, M, C, and BK are sequentially transferred to a predetermined position on an intermediate transfer belt 16, which is a belt-like intermediate transfer member, by primary transfer rollers 17Y, 17M, 17C, and 17BK.

A secondary transfer unit 18 then transfers the image in the respective colors from the intermediate transfer belt 16 onto a paper sheet P that is conveyed at a predetermined time by the paper conveying unit 2. As a secondary transfer roller 18*a* is pressed against the intermediate transfer belt 16, the secondary transfer unit 18 forms a transfer nip portion 19, and transfers the image onto the paper sheet P while conveying the paper sheet P.

To transfer the toner image onto the paper sheet P, the secondary transfer unit 18 applies a positive voltage with the secondary transfer roller 18*a* from the back surface of the paper sheet P. As a result, after the paper sheet P passes through the secondary transfer unit 18, the image formation surface of the paper sheet P on which the toner image is transferred is negatively charged, and the back surface is positively charged.

The paper conveying unit 2 that stores paper sheets P in this example includes paper feed trays 21 and paper feeding units 21*a* that deliver the paper sheets P stored in the paper feed trays 21. The paper conveying unit 2 also includes a main conveyance path 23 in which each paper sheet P delivered from the paper feed trays 21 is conveyed, and a reverse conveyance path 24 reverses each paper sheet P.

The main conveyance path 23 forms the conveyance path from the paper feed trays 21 to a paper discharge tray 25. When an outer paper feed tray 22 called a manual feed tray is opened and used, the conveyance path from the outer paper feed tray 22 joins the main conveyance path 23 on the upstream side of the junction between the main conveyance path 23 and the reverse conveyance path 24.

The paper conveying unit 2 includes resist rollers 26 that correct a tilt (also called a skew) of the paper sheet P being conveyed in the main conveyance path 23 and deviation of the position of the paper sheet P in the width direction perpendicular to the conveying direction. The paper conveying unit 2 also includes loop rollers 27 that bring each paper sheet into contact with the resist rollers 26.

The resist rollers 26 are formed with a pair of rollers that face each other and nip the paper sheet P being conveyed in the main conveyance path 23. The resist rollers 26 each have a shaft perpendicular to the direction of conveyance of the paper sheet P, and rotate in the direction of conveyance of the paper sheet P.

The loop rollers 27 are formed with a pair of rollers that face each other and nip the paper sheet P being conveyed in the main conveyance path 23. The loop rollers 27 are provided on the upstream side of the resist rollers 26 in the direction of conveyance of the paper sheet P. The loop rollers 27 each have a shaft perpendicular to the direction of conveyance of the paper sheet P, and rotate in the direction of conveyance of the paper sheet P, to convey the paper sheet P.

While the resist rollers 26 are stopped, the loop rollers 27 convey the paper sheet P, and bring the top of the paper sheet P into contact with a nip portion 26*a* formed with the contact portion between the pair of rollers. The paper sheet P is then conveyed until being bent into a loop, so that the tilt of the paper sheet P in the direction parallel to the surface of the paper sheet P is corrected.

After the tilt of the paper sheet P is corrected, the resist rollers 26 are driven and rotated in the direction of conveyance of the paper sheet P, so that the paper sheet P is conveyed while nipped. The resist rollers 26 are further moved in the width direction of the paper sheet P perpendicular to the direction of conveyance of the paper sheet P, so that the position of the paper sheet P in the width direction is corrected. The series of paper position correcting operations to correct deviation of the position of the paper sheet P in the width direction while the paper sheet P is being conveyed as described above are called resist fluctuations.

The reverse conveyance path 24 branches from the main conveyance path 23 on the downstream side of the fixing unit 3, and has a switching gate 23*a* at the branching point between the main conveyance path 23 and the reverse conveyance path 24. The reverse conveyance path 24 includes a first reverse conveyance path 24*a* that branches from the main conveyance path 23 and extends substantially in the horizontal direction below the main conveyance path 23. In the first reverse conveyance path 24*a*, the direction of conveyance of the paper sheet P is reversed from the direction indicated by an arrow D1 to the direction indicated by an arrow D2.

The reverse conveyance path 24 includes a second reverse conveyance path 24*b* that branches upward from the first reverse conveyance path 24*a* in the direction of conveyance indicated by the arrow D2 and is bent into an U-like shape, and a third reverse conveyance path 24*c* that extends from the second reverse conveyance path 24*b* and runs along the first reverse conveyance path 24*a*. The reverse conveyance path 24 further includes a fourth reverse conveyance path 24*d* that extends from the third reverse conveyance path 24*c*, is bent into an U-like shape, and joins the main conveyance path 23.

In the image forming apparatus 1A, a paper sheet P that has been conveyed along the main conveyance path 23 and has passed through the transfer nip portion 19 and the fixing unit 3 has an image formed on the surface facing upward. In a case where images are to be formed on both surfaces of a paper sheet P, the paper sheet P having an image formed on the surface facing upward is conveyed from the main conveyance path 23 into the first reverse conveyance path 24*a* of the reverse conveyance path 24, so that the image formation surface faces downward.

The paper sheet P conveyed into the first reverse conveyance path 24*a* is then conveyed from the second reverse conveyance path 24*b* into the third reverse conveyance path 24*c*, so that the image formation surface faces upward. The paper sheet P conveyed into the third reverse conveyance path 24*c* then conveyed from the fourth reverse conveyance path 24*d* into the main conveyance path 23 so that the image formation surface faces downward. The paper sheet P is reversed in this manner, and an image can be formed on the other surface that is now facing upward.

The fixing unit 3 is an example of the fixing unit, and performs a fixing process on a paper sheet P having an image transferred thereonto, to fix the image onto the paper sheet P. The fixing unit 3 includes a fixing roller 31 and a fixing roller 32 as a pair of fixing members pressed against each other. As the fixing roller 31 and the fixing roller 32 are pressed against each other, a fixing nip portion 33 is formed.

The fixing unit 3 also includes a fixing heater 34 as a heating unit that heats a fixing member. The fixing heater 34 heats the fixing roller 31. The fixing heater 34 is turned on by application of current, and may be formed with a halogen lamp, for example. The fixing unit 3 conveys the paper sheet P, and performs pressure fixing with the pair of fixing rollers 31 and 32 and thermal fixing with the fixing heater 34, so that the image is fixed onto the fixing paper P.

The charging unit 4 is an example of the charging unit, and is provided on the downstream side of the fixing unit 3 in the direction of conveyance of a paper sheet P in the main conveyance path 23. The charging unit 4 electrically charges a paper sheet P that has passed the fixing unit 3, and controls the potential of the front and back surfaces of the paper sheet P.

The charging unit 4 includes a pair of charging rollers 40*a* and 40*b* that face each other and nip the paper sheet P being conveyed in the main conveyance path 23. The charging rollers 40*a* and 40*b* each have a shaft perpendicular to the direction of conveyance of the paper sheet P, and rotate in the direction of conveyance of the paper sheet P.

A DC voltage or an AC superimposed voltage that has a voltage value and/or a current value controlled and further has the sign of the voltage controlled is applied to the charging rollers 40*a* and 40*b* of the charging unit 4, so that the potential of the front and back surfaces of the paper sheet P are controlled.

The cooling unit 5 is an example of the adhesion preventing unit. The cooling unit 5 is provided on the downstream side of the fixing unit 3 and on the upstream side of the charging unit 4 in the direction of conveyance of the paper sheet P being conveyed in the main conveyance path 23. The cooling unit 5 cools the toner on the paper sheet P that has passed through the fixing unit 3 and has an increased temperature. In this example, the cooling unit 5 is formed with a fan that blows air against the paper sheet P being conveyed in the main conveyance path 23 between the fixing unit 3 and the charging unit 4.

In the image forming apparatus 1A, the toner on the paper sheet P having a temperature increased by the fixing unit 3 is cooled by the cooling unit 5. As a result, the paper sheet P having the toner temperature lowered to a predetermined temperature equal to or lower than the crystallization temperature of the wax is conveyed into the charging unit 4.

The temperature sensing unit 6 is an example of the temperature sensing unit. The temperature sensing unit 6 is provided on the downstream side of the fixing unit 3 and faces one surface of a paper sheet P on the upstream side of the cooling unit 5 in the direction of conveyance of the paper sheet P in the main conveyance path 23. The temperature sensing unit 6 senses the temperature of the toner on the image formation surface that is the one surface of the paper sheet P having passed through the fixing unit 3.

<Example of the Control Function of the Image Forming Apparatus>

Figure 2:
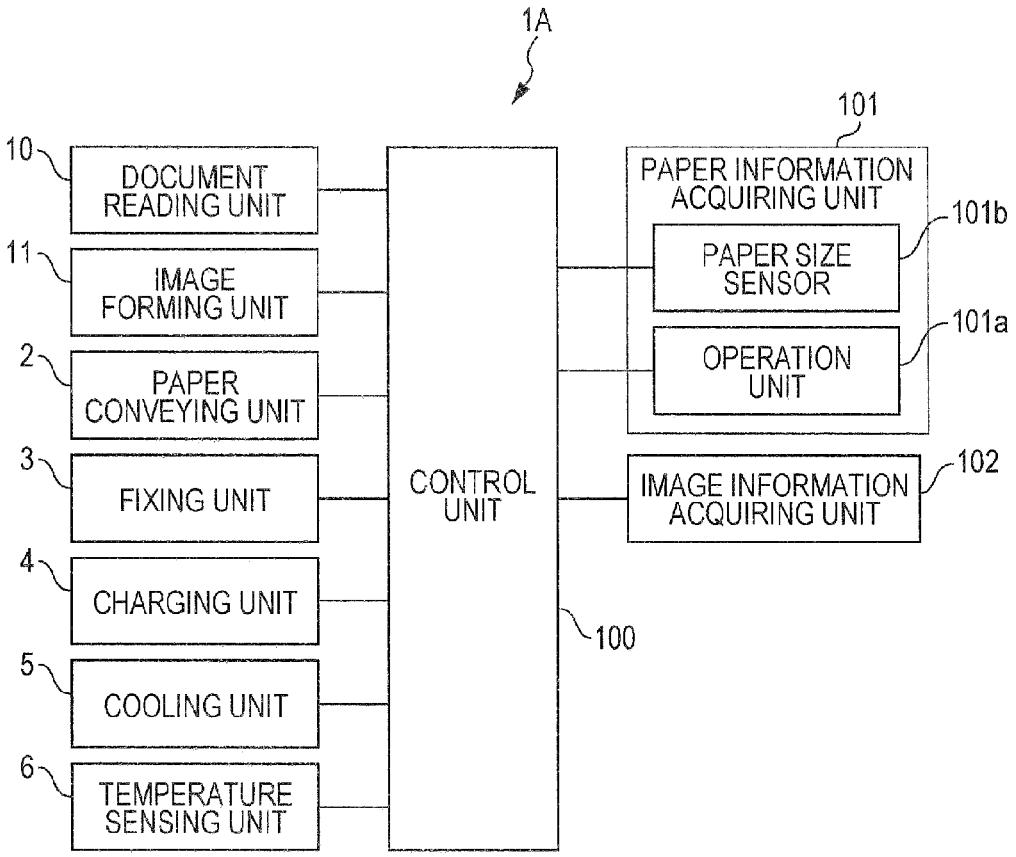
FIG. 2 is a functional block diagram showing an example of a control function of the image forming apparatus according to one or more embodiments.

FIG. 2 is a functional block diagram showing an example of a control function of the image forming apparatus according to one or more embodiments of the invention. FIG. 2 illustrates a control function related to an operation to control the temperature of the toner fixed onto a paper sheet P and thus prevent adhesion of the wax contained in the toner on the paper sheet P to the charging rollers 40*a* and 40*b*.

The image forming apparatus 1A includes a control unit 100 that performs a series of control processes to supply a paper sheet P, form an image, and discharge the paper sheet P. The control unit 100 is an example of the control unit. The control unit 100 includes a microprocessor called a CPU or an MPU, and memories such as a RAM or a ROM as the storage unit.

The image forming apparatus 1A also includes a paper information acquiring unit 101 that acquires paper information such as the size of the paper sheet, and an image information acquiring unit 102 that acquires image information such as image data. The paper information acquiring unit 101 is an exemplary paper information acquiring unit. The paper information acquiring unit 101 includes an operation unit 101*a* serving as an operation unit through which a basis weight, a size, a paper type, and the like are selected for the paper sheet P, and a paper size sensor 101*b* that senses the sizes of the paper sheets P set in the paper feed trays 21. The image information acquiring unit 102 is an exemplary image information acquiring unit. The image information acquiring unit 102 calculates the amount of toner that adheres to each page in an image forming operation.

In a normal operation to form an image on a paper sheet P in the image forming apparatus 1A, the control unit 100 controls the paper conveying unit 2 to convey the paper sheet P. The control unit 100 controls the image forming unit 11 based on image data obtained from a document by the document reading unit 10, or on image data obtained from outside, so that an image is formed on the paper sheet P. The control unit 100 also controls the fixing unit 3 to fix the image onto the paper sheet P and discharge the paper sheet P having the image formed thereon.

The control unit 100 controls the charging unit 4 to adjust the surface potential of the paper sheet P to be discharged to such a value that the adhesion of the paper sheet P to the preceding paper sheet P becomes weaker and repulsion between the paper sheets becomes smaller. By doing so, the control unit 100 prevents trouble in stacking paper sheets P due to adhesion or repulsion between the paper sheets P to be stacked when the paper sheets P are successively discharged.

The control unit 100 controls the surface potential of the charging roller 40*a* and the charging roller 40*b* to be in contact with each paper sheet P. To do so, the control unit 100 performs constant voltage control to change the current value while maintaining the voltage value at a constant value, or performs constant current control to change the voltage value while maintaining the current value at a constant value, for example.

The control unit 100 sets beforehand the current value and/or the voltage value to be used in controlling the charging unit 4 so that the surface potential of the charging rollers 40*a* and 40*b* becomes a predetermined value. The control unit 100 may include a potential sensing unit that senses the potential of each paper sheet P. In such a case, the control unit 100 calculates the set current and the set voltage in accordance with the potential of the paper sheet P sensed by the potential sensing unit.

The control unit 100 also controls the cooling unit 5 in accordance with the temperature of the toner on the paper sheet P sensed by the temperature sensing unit 6. In accordance with the difference between the temperature of the toner on the paper sheet P sensed by the temperature sensing unit 6 and the crystallization temperature of the wax, the control unit 100 determines whether to allow the cooling unit 5 to perform a cooling operation and sets an output of the cooling operation.

<Example Operation of the Image Forming Apparatus>

Figure 3A:
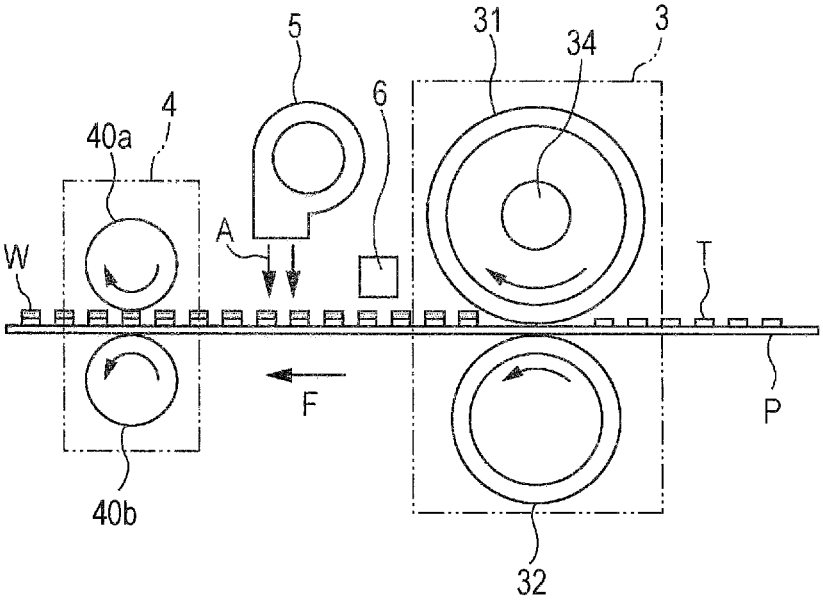
FIGS. 3A and 3B are diagrams for explaining an example operation of the image forming apparatus according to one or more embodiments.
Figure 3B:
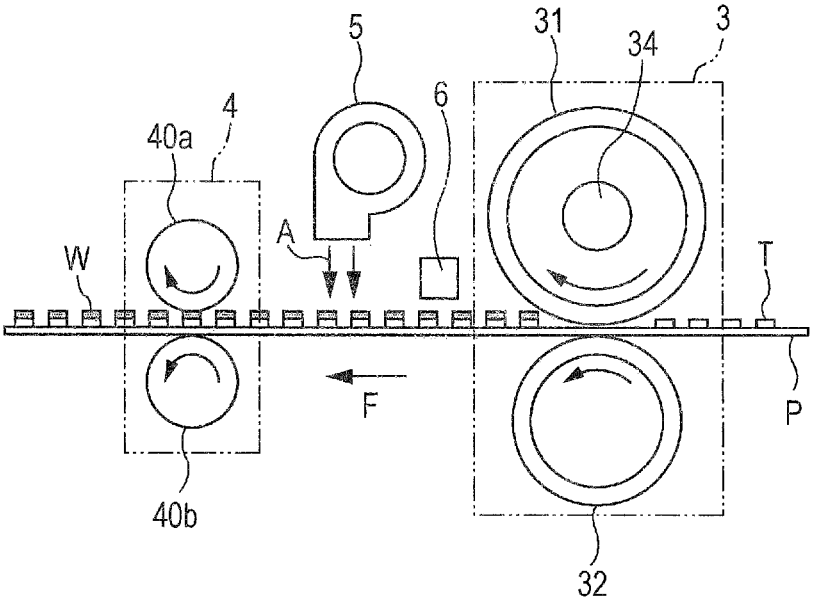
Figure 4A:
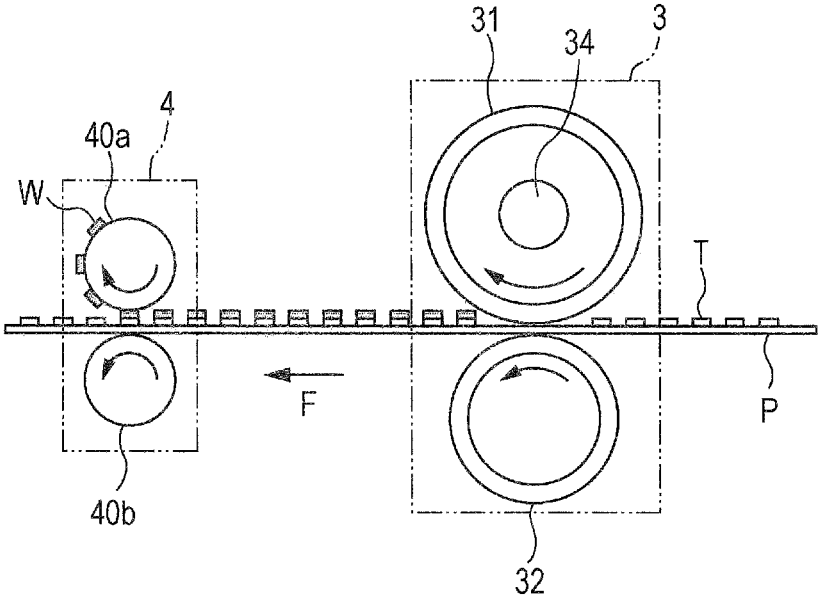
FIGS. 4A and 4B are diagrams for explaining an example operation of a conventional image forming apparatus.
Figure 4B:
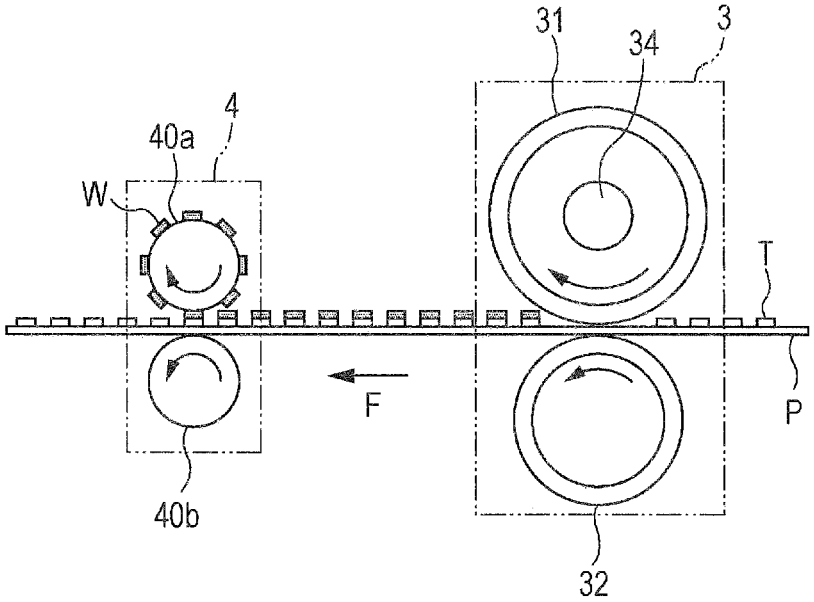

FIGS. 3A and 3B are diagrams for explaining an example operation of the image forming apparatus according to one or more embodiments of the invention. FIGS. 4A and 4B are diagrams for explaining an example operation of a conventional image forming apparatus. Referring to these drawings, operation of the image forming apparatus according to one or more embodiments of the invention is described.

The toner to be used in the image forming apparatus 1A has wax added thereto to enhance the separability between the fixing roller 31 and a paper sheet P in the fixing unit 3. The principal component of the wax is carnauba wax in this example, and the crystallization temperature of carnauba wax is 80° C.

In the image forming apparatus 1A, the fixing unit 3 heats the paper sheet P with the fixing roller 31, to fix the toner onto the paper sheet P. If the temperature of the toner T on the paper sheet P that has passed through the fixing unit 3 and is conveyed into the charging unit 4 is higher than the crystallization temperature of the wax W, the paper sheet P having the melted wax W thereon is conveyed in the direction indicated by an arrow F, and inserted between the charging rollers 40*a* and 40*b* of the charging unit 4.

As the paper sheet P having the melted wax W thereon is conveyed into the charging unit 4, the wax W adheres to the charging roller 40*a* as shown in FIG. 4A. In the case of two-side printing, the wax W might also adhere to the charging roller 40*b*. As shown in FIG. 4B, after the charging roller 40*a* rotates one revolution, the amount of the wax W adhering to the charging roller 40*a* doubles for the next image. Since the wax W is an insulator, the wax W adhering to the surface of the charging roller 40*a* having conductive properties degrades charging performance.

To counter this, the control unit 100 shown in FIG. 2 controls the temperature sensing unit 6 to sense the temperature of the toner T on the paper sheet P that has passed through the fixing unit 3 and is conveyed into the charging unit 4. If the temperature of the toner T on the paper sheet P is higher than the crystallization temperature of the wax W, the control unit 100 controls the cooling unit 5 to blow air A onto the paper sheet P so that the temperature of the toner T on the paper sheet P becomes equal to or lower than the crystallization temperature of the wax W.

Once the temperature of the toner T on the paper sheet P that has passed through the fixing unit 3 becomes equal to or lower than the crystallization temperature of the wax W, the wax W becomes solid. Consequently, the wax W is prevented from adhering to the charging rollers 40*a* and 40*b* when the paper sheet P is conveyed in the direction of the arrow F and passes through the charging unit 4, as shown in FIG. 3A.

Thus, the wax W is prevented from adhering to the charging roller 40*a* even after the charging roller 40*a* rotates one revolution, as shown in FIG. 3B. In this manner, desired charging performance is maintained and stabilized.

As the wax W is prevented from adhering to the charging roller 40*a* in the above manner, degradation of the charging performance of the charging rollers 40*a* and 40*b* due to adhesion of the wax W is prevented, and the service life of the charging rollers 40*a* and 40*b* can be prolonged. Thus, cleaning and changing rollers can be delayed. Instead of the cooling unit 5 that blows air onto a paper sheet P, a temperature-controllable roller may be brought into contact with a paper sheet P and be used as the cooling unit to control the toner temperature. In the case where such a roller is used, the roller is brought into contact with the back surface of a paper sheet P.

<Another Example Structure of the Image Forming Apparatus>

In another example structure that prevents adhesion of the wax to the charging rollers 40*a* and 40*b* by controlling the temperature of the toner on a paper sheet P, the set temperature of the fixing heater 34 may be controlled based on the temperature of the toner on the paper sheet P sensed by the temperature sensing unit 6.

By controlling the set temperature of the fixing heater 34, the control unit 100 controls the temperature of the fixing roller 31 so that the temperature of the toner on the paper sheet P to be inserted between the charging roller 40*a* and the charging roller 40*b* becomes equal to or lower than the crystallization temperature of the wax. The adhesion preventing unit may be embodied by the fixing unit 3 in this manner. Alternatively, the temperature of the toner on the paper sheet P may be controlled by both the cooling unit 5 and the fixing unit 3 in accordance with the temperature of the toner on the paper sheet P sensed by the temperature sensing unit 6.

Figure 5:
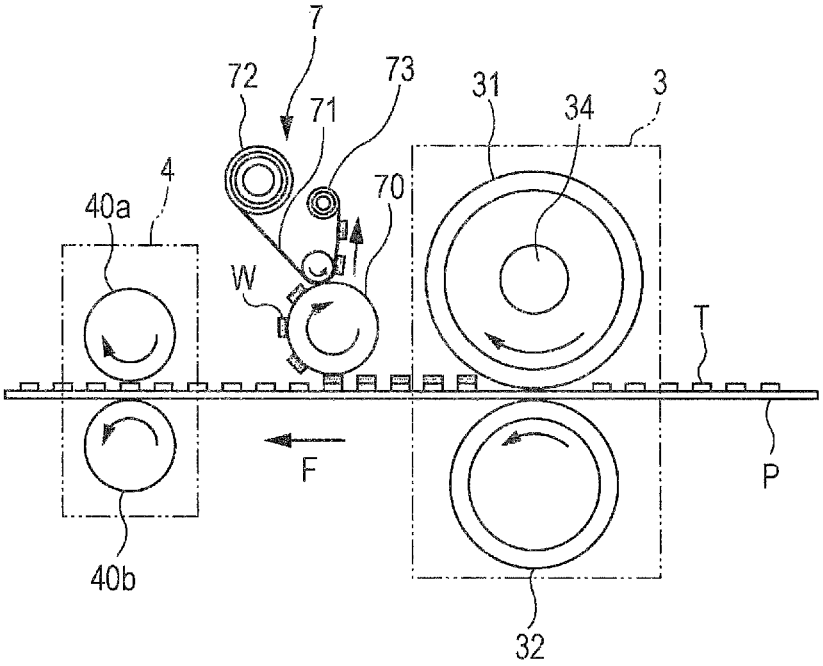
FIG. 5 is a diagram for explaining the principal components of another example structure of the image forming apparatus according to one or more embodiments.

FIG. 5 is a diagram for explaining the principal components of another example structure of the image forming apparatus according to one or more embodiments of the invention. This image forming apparatus includes a wax removing unit 7 as another example component to prevent adhesion of the wax to the charging rollers 40*a* and 40*b*.

The wax removing unit 7 is an example of the adhesion preventing unit. The wax removing unit 7 is provided on the downstream side of the fixing unit 3 and on the upstream side of the charging unit 4 in the direction of conveyance of the paper sheet P being conveyed in the main conveyance path 23. The wax removing unit 7 removes the wax from the paper sheet P that has passed through the fixing unit 3 and has an increased temperature. In this example, the wax removing unit 7 includes a removing roller 70 that removes the wax W from the paper sheet P, a cleaning web 71 that clears the wax W adhering to the removing roller 70, a delivering roller 72 around which the cleaning web 71 prior to cleaning is wound, a winding roller 73 that winds up the cleaning web 71 after cleaning, and a motor (not shown) that drives the winding roller 73 and the like.

In the image forming apparatus 1A, the paper sheet P that has passed through the fixing unit 3 and has an increased toner temperature is conveyed in synchronization with the rotation of the removing roller 70 while being in contact with the removing roller 70, so that the wax W melted by the temperature increased to a higher temperature than the crystallization temperature adheres to the removing roller 70, and is removed from the paper sheet P. Consequently, the paper sheet P from which the wax W has been removed is conveyed into the charging unit 4. The wax W adhering to the removing roller 70 is collected by the cleaning web 71 rotating in the direction indicated by an arrow. Thus, degradation of the wax removal performance of the removing roller 70 can be prevented.

The structure that removes the wax with the wax removing unit 7 may be employed in addition to the structure in which the cooling unit 5 controls the temperature of the toner on the paper sheet P in accordance with the temperature of the toner on a paper sheet P sensed by the temperature sensing unit 6. The structure that removes the wax with the wax removing unit 7 may also be employed in addition to the structure in which the cooling unit 5 and the fixing unit 3 control the temperature of the toner on a paper sheet P in accordance with the temperature of the toner on the paper sheet P sensed by the temperature sensing unit 6.

<Another Embodiment of an Image Forming Apparatus>

In the image forming apparatus 1A, the temperature of the toner on a paper sheet P to be inserted between the charging roller 40*a* and the charging roller 40*b* is adjusted to a temperature equal to or lower than the crystallization temperature of the wax, so that adhesion of the wax to the charging rollers 40*a* and 40*b* can be prevented. However, adhesion of the wax due to long-term use is not completely prevented.

Particularly, in the case of an image with a high print coverage rate or a large print area on a paper sheet P, or in the case of an image having a large amount of adhering toner, the possibility of the wax adhering to the charging roller 40*a* might become higher due to long-term use. In view of this, the effect of the cooling unit 5 blowing air onto a paper sheet P to prevent adhesion of the wax to the charging roller 40*a* might become smaller if the amount of adhering toner is large. In the case of two-side printing, the wax might also adhere to the charging roller 40*b* due to long-term use.

To counter this, the control unit 100 may control the charging unit 4, and may further control the cooling unit 5, in addition to controlling the temperature of the toner on the paper sheet P to be conveyed into the charging unit 4 and be inserted between the charging roller 40*a* and the charging roller 40*b* in accordance with the temperature of the toner on the paper sheet P sensed by the temperature sensing unit 6.

In an example of a control operation, the control unit 100 determines the print coverage rate and the print area from the paper information such as the size of the paper sheet P acquired by the paper information acquiring unit 101 and the image information such as image data acquired by the image information acquiring unit 102. The control unit 100 then determines the amount of adhering toner from the print coverage rate and the print area.

If the amount of adhering toner exceeds a predetermined threshold, the control unit 100 increases the set current and/or the set voltage to be used in controlling the charging unit 4. Alternatively, the control unit 100 increases, in a stepwise manner, the set current and/or the set voltage to be used in controlling the charging unit 4. The control unit 100 determines the cumulative amount of adhering toner. If the cumulative amount of adhering toner exceeds a predetermined threshold, the control unit 100 may perform control to increase the set voltage, for example.

The structure that drives the charging unit 4 through constant voltage control may set a correction value for the set voltage beforehand in accordance with the amount of adhering toner, and change the set voltage in accordance with the amount of adhering toner. The structure that drives the charging unit 4 through constant current control may set a correction value for the set current beforehand in accordance with the amount of adhering toner, and change the set current in accordance with the amount of adhering toner.

The effect to prevent adhesion of the wax to the charging rollers 40*a* and 40*b* can change with the amount of adhering toner. To prevent a decrease of the effect, the control unit 100 may change the temperature of the fixing heater 34 in accordance with the amount of adhering toner. By doing so, the control unit 100 prevents a rise in the temperature of the toner on the paper sheet P. Otherwise, a rise in the temperature of the toner on the paper sheet P will cause melting of the wax.

If the amount of adhering toner exceeds the predetermined threshold, the control unit 100 lowers the set temperature of the fixing heater 34 in accordance with fixing performance, and lowers the temperature of the fixing roller 31 to a temperature lower than that in a case where the amount of adhering toner is equal to or smaller than the threshold. By doing so, the control unit 100 prevents a rise in the temperature of the toner on the paper sheet P. Alternatively, the control unit 100 lowers the set temperature of the fixing heater 34 in a stepwise manner in accordance with an increase in the amount of adhering toner.

Further, since the effect to prevent adhesion of the wax to the charging roller 40*a* changes with the amount of adhering toner, the control unit 100 may change the output of the cooling unit 5 in accordance with the amount of adhering toner so that the effect to prevent adhesion of the wax to the charging roller 40*a* is not reduced.

If the amount of adhering toner exceeds the predetermined threshold, the control unit 100 increases the output of the cooling unit 5, to enhance the effect to lower the temperature of the toner on the paper sheet P to a temperature equal to or lower than the crystallization temperature of the wax. Alternatively, the control unit 100 increases the output of the cooling unit 5 in a stepwise manner in accordance with an increase in the amount of adhering toner.

Since the effect to prevent adhesion of the wax to the charging rollers 40*a* and 40*b* changes due to long-term use or changes with the amount of adhering toner, the set voltage or the set current to be used in controlling the charging unit 4 is changed so that the effect to prevent adhesion of the wax to the charging rollers 40*a* and 40*b* is not reduced. This structure may issue a notification of the time to replace the charging rollers 40*a* and 40*b*.

Figure 6:
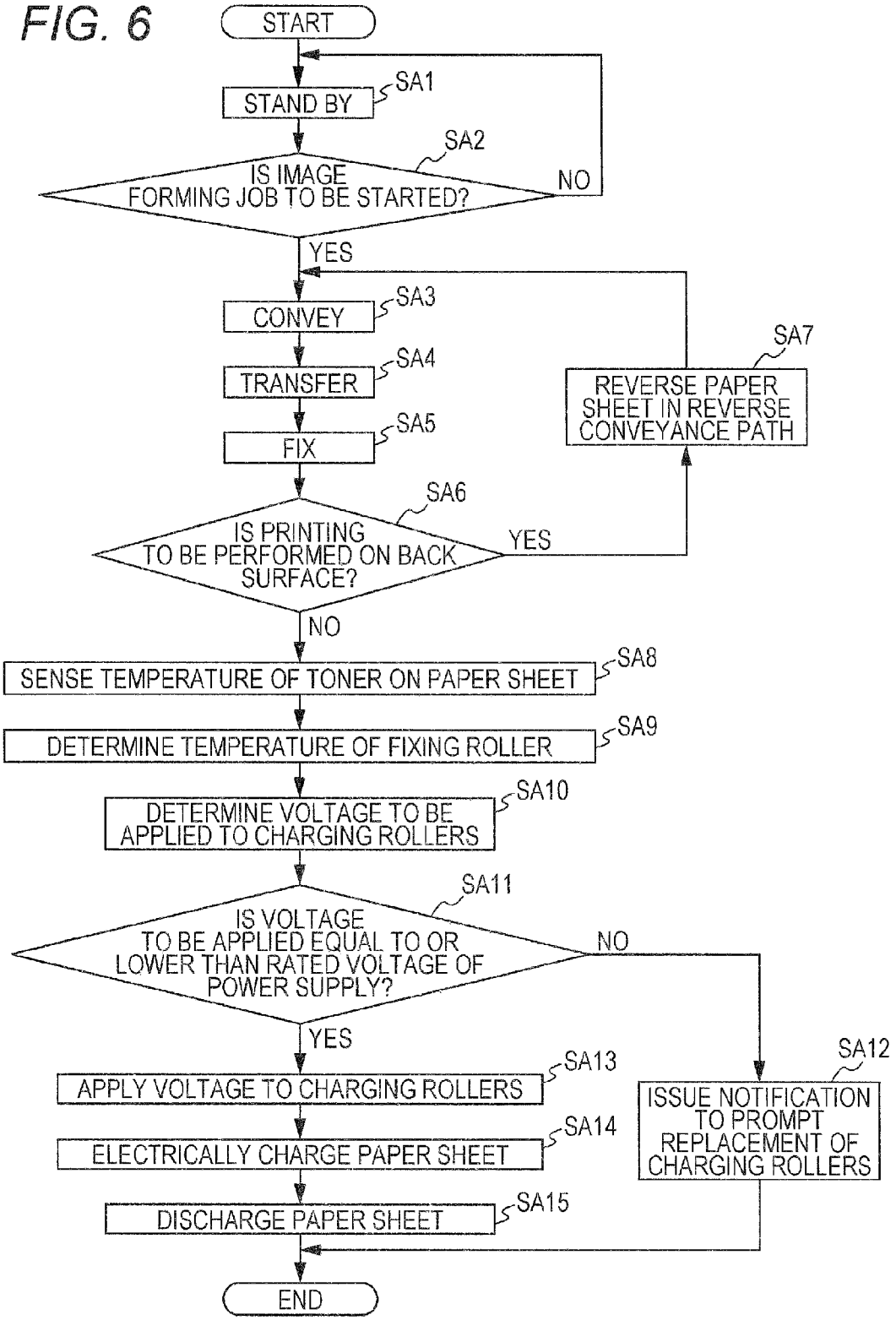
FIG. 6 is a flowchart showing an example operation to issue a notification of the time to replace charging rollers.

FIG. 6 is a flowchart showing an example operation to issue a notification of the time to replace the charging rollers. In steps SA1 and SA2 in FIG. 6, the control unit 100 determines whether an image forming job is to be started, and stands by until an image forming job is started.

After an image forming job is started, the control unit 100 in step SA3 in FIG. 6 controls the paper conveying unit 2 to convey a paper sheet P. In step SA4 in FIG. 6, the control unit 100 also controls the image forming unit 11 based on image data obtained from a document by the document reading unit 10, or on image data obtained from outside, so the image is transferred onto the intermediate transfer belt 16 through primary transfer. The image transferred onto the intermediate transfer belt 16 through the primary transfer is transferred onto the paper sheet P through secondary transfer performed by the secondary transfer unit 18.

After conveying the paper sheet P having the image transferred thereonto to the fixing unit 3, the control unit 100 in step SA5 in FIG. 6 controls the fixing unit 3 to fix the image onto the paper sheet P. The control unit 100 in step SA6 in FIG. 6 determines whether the image forming job is two-side printing and printing is to be performed on the back surface. If the control unit 100 determines that printing is to be performed on the back surface, the control unit 100 in step SA7 in FIG. 6 conveys the paper sheet P into the reverse conveyance path 24, to reverse the paper sheet P and return the reversed paper sheet P into the main conveyance path 23.

If the control unit 100 determines in step SA6 in FIG. 6 that the image forming job is one-side printing and printing is not to be performed on the back surface, or that the image forming job is two-side printing but printing is not to be performed on the back surface because printing has already been performed on both surfaces, the control unit 100 in step SA8 controls the temperature sensing unit 6 to sense the temperature of the toner on the paper sheet P.

In step SA9 in FIG. 6, in accordance with the toner temperature sensed by the temperature sensing unit 6 and the cumulative number of printed paper sheets, the control unit 100 determines the temperature of the fixing heater 34 that performs temperature control on the fixing roller 31. In the case of constant current control, the control unit 100 in step SA10 determines the value of the voltage to be applied to the charging rollers 40*a* and 40*b*.

In step SA11 in FIG. 6, the control unit 100 determines whether the value of the voltage to be applied to the charging rollers 40*a* and 40*b* is equal to or lower than the rated voltage of the power supply. If the voltage to be applied is determined to be higher than the rated voltage, the control unit 100 in step SA12 determines that the time to replace the charging rollers 40*a* and 40*b* has come, and issues a notification to prompt replacement of the charging rollers. The notification to prompt replacement of the charging rollers is issued by displaying a message or the like on a display unit that forms the operation unit 101*a* provided in the image forming apparatus 1A.

If the control unit 100 determines in step SA11 in FIG. 6 that the value of the voltage to be applied to the charging rollers 40*a* and 40*b* is equal to or lower than the rated voltage of the power supply, the control unit 100 in step SA13 applies the set voltage to the charging rollers 40*a* and 40*b*, and, in step SA14, electrically charges the paper sheet P at a predetermined potential. In step SA15, the paper sheet P on which the image has been formed and electrical charging has been performed is discharged onto the paper discharge tray 25.

Figure 7:
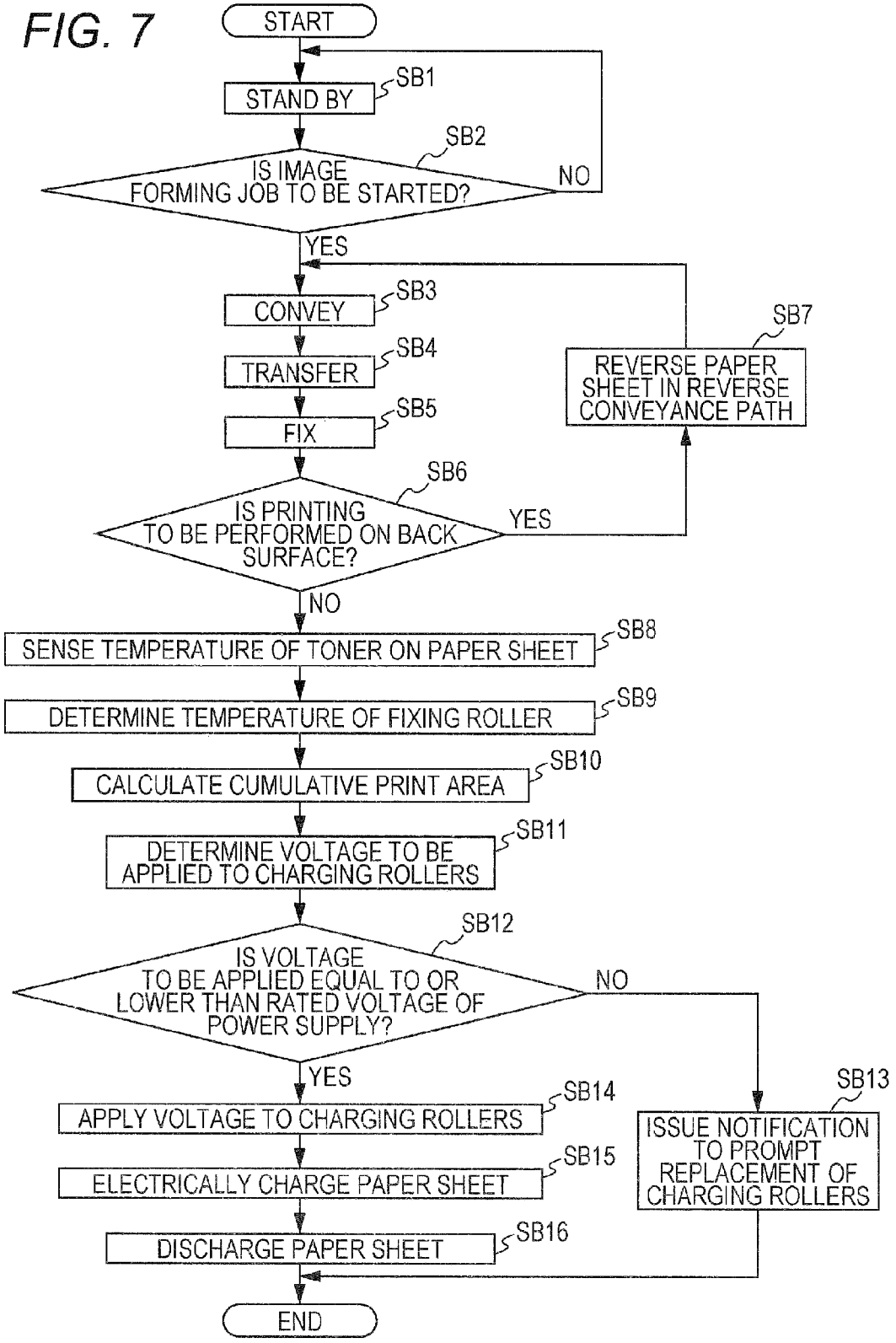
FIG. 7 is a flowchart showing another example operation to issue a notification of the time to replace charging rollers.

FIG. 7 is a flowchart showing another example operation to issue a notification of the time to replace the charging rollers. In steps SB1 and SB2 in FIG. 7, the control unit 100 determines whether an image forming job is to be started, and stands by until an image forming job is started.

After an image forming job is started, the control unit 100 in step SB3 in FIG. 7 controls the paper conveying unit 2 to convey a paper sheet P. In step SB4 in FIG. 7, the control unit 100 also controls the image forming unit 11 based on image data, to transfer the image onto the intermediate transfer belt 16 through primary transfer. The image transferred onto the intermediate transfer belt 16 through the primary transfer is transferred onto the paper sheet P through secondary transfer performed by the secondary transfer unit 18.

After conveying the paper sheet P having the image transferred thereonto to the fixing unit 3, the control unit 100 in step SB5 in FIG. 7 controls the fixing unit 3 to fix the image onto the paper sheet P. The control unit 100 in step SB6 in FIG. 7 determines whether the image forming job is two-side printing and printing is to be performed on the back surface. If the control unit 100 determines that printing is to be performed on the back surface, the control unit 100 in step SB7 in FIG. 7 conveys the paper sheet P into the reverse conveyance path 24, to reverse the paper sheet P and return the reversed paper sheet P into the main conveyance path 23.

If the control unit 100 determines in step SB6 in FIG. 7 that the image forming job is one-side printing and printing is not to be performed on the back surface, or that the image forming job is two-side printing but printing is not to be performed on the back surface because printing has already been performed on both surfaces, the control unit 100 in step SB8 controls the temperature sensing unit 6 to sense the temperature of the toner on the paper sheet P.

In accordance with the toner temperature sensed by the temperature sensing unit 6, the control unit 100 in step SB9 in FIG. 7 determines the temperature of the fixing heater 34 that performs temperature control on the fixing roller 31. In step SB10, the control unit 100 determines the cumulative value of the print area, and also determines the amount of adhering toner from the cumulative value of the print area. In the case of constant voltage control, the control unit 100 in step SB11 determines the correction value for the value of the voltage to be applied to the charging rollers 40*a* and 40*b*.

In step SB12 in FIG. 7, the control unit 100 determines whether the value of the voltage to be applied to the charging rollers 40*a* and 40*b* is equal to or lower than the rated voltage of the power supply. If the voltage to be applied is determined to be higher than the rated voltage, the control unit 100 in step SB13 determines that the time to replace the charging rollers 40*a* and 40*b* has come, and issues a notification to prompt replacement of the charging rollers by displaying a message or the like.

If the control unit 100 determines in step SB12 in FIG. 7 that the value of the voltage to be applied to the charging rollers 40*a* and 40*b* is equal to or lower than the rated voltage of the power supply, the control unit 100 in step SB14 applies the set voltage to the charging rollers 40*a* and 40*b*, and, in step SB15, electrically charges the paper sheet P at a predetermined potential. In step SB16, the paper sheet P on which the image has been formed and electrical charging has been performed is discharged onto the paper discharge tray 25.

<Example of an Image Forming System>

Figure 8:
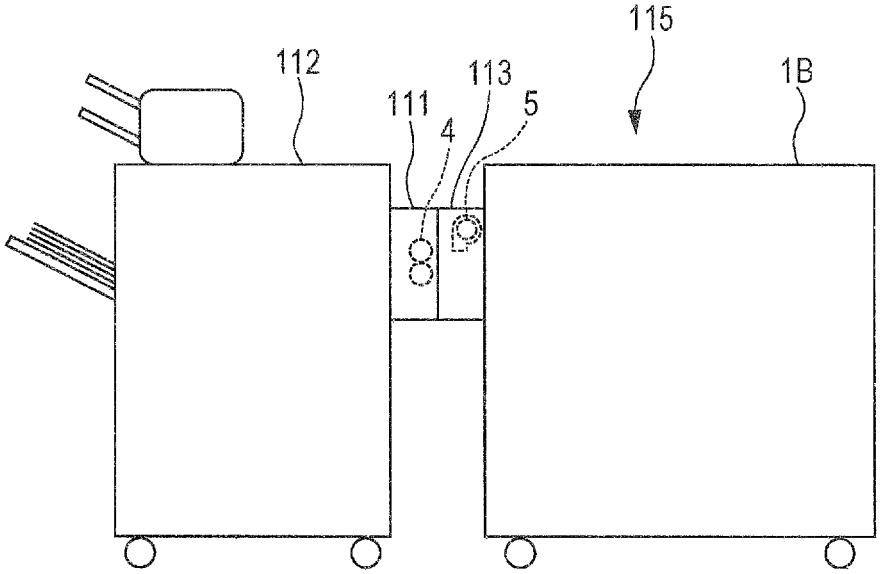
FIG. 8 is a diagram showing an example configuration of an image forming system according to one or more embodiments.

FIG. 8 is a diagram showing an example configuration of an image forming system according to one or more embodiments of the invention. The image forming apparatus 1A according to one or more embodiments of the invention includes the charging unit 4 and the cooling unit 5. In an image forming system 115, however, a charging device 111 that includes the charging unit 4 and is independent of an image forming apparatus 1B may be provided in the stage after the image forming apparatus 1B, and the charging device 111 is used in combination with a post-processing device 112 such as a paper stapling machine. The cooling unit 5 may be provided either in the image forming apparatus 1B or in the charging device 111. Alternatively, a cooling device 113 that includes the cooling unit 5 and is independent of the image forming apparatus 1B and the charging device 111 may be provided as an adhesion preventing device between the image forming apparatus 1B and the charging device 111.

The present invention is applied to image forming apparatuses that electrically charge a paper sheet and transfer a toner image onto the paper sheet.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

an image forming unit comprising a transfer roller that forms an image by transferring toner onto a paper sheet;

a fixing unit comprising a fixing roller that fixes the image onto the paper sheet;

a temperature sensor that senses a temperature of the toner fixed on the paper sheet;

a charging unit comprising a charging roller that electrically charges the paper sheet;

an adhesion preventing unit comprising at least one of a cooling fan or a wax removing roller that prevents adhesion of wax to the charging unit, wherein the wax is contained in the toner transferred onto the paper sheet, and the adhesion preventing unit is located on an upstream side of the charging unit in a direction of conveyance of the paper sheet; and a controller that controls a temperature of heat to be applied to the paper sheet by the fixing unit by causing the toner temperature sensed by the temperature sensor to be equal to or lower than a crystallization temperature of the wax.

2. The image forming apparatus according to claim 1, wherein the cooling fan blows air onto the paper sheet, and the controller controls the cooling fan in accordance with the toner temperature sensed by the temperature sensor.

3. The image forming apparatus according to claim 2, wherein charge control to be performed on the charging unit is constant current control, and a potential of the paper sheet is controlled while a voltage value is varied.

4. The image forming apparatus according to claim 2, wherein charge control to be performed on the charging unit is constant voltage control, an amount of adhering toner is calculated from a cumulative print area on the paper sheet, and a value of voltage to be applied to the charging unit is corrected in accordance with an amount of adhering toner.

5. The image forming apparatus according to claim 2, wherein an amount of adhering toner is calculated from a print coverage rate on the paper sheet, and the cooling fan is controlled in accordance with an amount of adhering toner.

6. The image forming apparatus according to claim 2, wherein an amount of adhering toner is calculated from a print coverage rate on the paper sheet, and the temperature of heat to be applied to the paper sheet by the fixing unit is controlled in accordance with an amount of adhering toner.

7. The image forming apparatus according to claim 1, wherein the wax removing roller removes the wax from the paper sheet.

8. The image forming apparatus according to claim 2, wherein charge control to be performed on the charging unit is constant current control, and a notification of a time to replace the charging unit is issued before a value of voltage to be applied to the charging unit exceeds a value of rated voltage.

9. The image forming apparatus according to claim 2, wherein charge control to be performed on the charging unit is constant voltage control, and a notification of a time to replace the charging unit is issued before a correction value for a value of voltage to be applied to the charging unit exceeds a value of rated voltage, the correction value being based on an amount of adhering toner calculated from a cumulative print area on the paper sheet.

10. An image forming system comprising:

an image forming apparatus comprising:

an image forming unit comprising a transfer roller that forms an image by transferring toner onto a paper sheet;

a fixing unit comprising a fixing roller that fixes the image onto the paper sheet; and a temperature sensor that senses a temperature of the toner fixed on the paper sheet;

a charging device comprising a charging roller that electrically charges the paper sheet;

an adhesion preventing device comprising at least one of a cooling fan or a wax removing roller that prevents adhesion of wax to the charging device, wherein the wax is contained in the toner transferred onto the paper sheet, and the adhesion preventing device is located on an upstream side of the charging device in a direction of conveyance of the paper sheet; and a controller that controls a temperature of heat to be applied to the paper sheet by the fixing unit by causing the toner temperature sensed by the temperature sensor to be equal to or lower than a crystallization temperature of the wax.

* * * * *